US010358321B2

(12) United States Patent
Simcik et al.

(10) Patent No.: US 10,358,321 B2
(45) Date of Patent: Jul. 23, 2019

(54) ELEVATOR SYSTEM AND METHOD OF CANCELLING PASSENGER REQUESTED FLOOR DESTINATION

(71) Applicant: Otis Elevator Company, Farmington, CT (US)

(72) Inventors: Paul A. Simcik, Southington, CT (US); Emily Baldi, East Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 211 days.

(21) Appl. No.: 15/287,031

(22) Filed: Oct. 6, 2016

(65) Prior Publication Data

US 2018/0099838 A1 Apr. 12, 2018

(51) Int. Cl.

| | |
|---|---|
| ***B66B 1/16*** | (2006.01) |
| ***B66B 1/46*** | (2006.01) |
| ***B66B 3/00*** | (2006.01) |
| ***B66B 9/00*** | (2006.01) |

(52) U.S. Cl.

CPC ..... *B66B 1/468* (2013.01); *B66B 3/002* (2013.01); *B66B 3/004* (2013.01); *B66B 9/00* (2013.01); *B66B 2201/463* (2013.01); *B66B 2201/4607* (2013.01); *B66B 2201/4684* (2013.01)

(58) Field of Classification Search

CPC ..... B66B 1/468; B66B 3/002; B66B 3/004; B66B 9/00; B66B 2201/4607

USPC ..... 187/381

See application file for complete search history.

(56) References Cited

U.S. PATENT DOCUMENTS

| | | | | |
|---|---|---|---|---|
| 4,915,197 | A | 4/1990 | Schroder | |
| 5,952,626 | A | 9/1999 | Zaharia | |
| 6,209,685 | B1 | 4/2001 | Zaharia et al. | |
| 9,238,568 | B2 | 1/2016 | Nonami | |
| 2010/0078266 | A1 | 4/2010 | Choi | |
| 2012/0152660 | A1* | 6/2012 | Fujihata | B66B 1/468 187/381 |

(Continued)

FOREIGN PATENT DOCUMENTS

| | | | |
|---|---|---|---|
| CA | 2332727 | A1 | 7/2002 |
| CN | 103787161 | A | 5/2014 |

(Continued)

OTHER PUBLICATIONS

International Search Report for application No. PCT/US2017/055323 dated Feb. 1, 2018; 6 pages.

(Continued)

*Primary Examiner* — Jeffrey Donels
(74) *Attorney, Agent, or Firm* — Cantor Colburn LLP

(57) ABSTRACT

An elevator system includes an elevator car, a call panel, a controller, and a floor cancellation feature. The elevator car is adapted to travel in a hoistway defined by a building and between floors of the building. The call panel is located for passenger interaction, includes a plurality of floor selections, and communicates with the controller. The floor cancellation feature is associated with at least one of the call panel and the controller. The controller is configured to operate between a floor cancellation permit state and a floor cancellation restricted state, thereby respectively enabling and disabling the floor cancellation feature, and track at least one event associated with the floor cancellation restricted state.

15 Claims, 3 Drawing Sheets

(56) References Cited

U.S. PATENT DOCUMENTS

| | | | | |
|---|---|---|---|---|
| 2014/0060978 | A1* | 3/2014 | Koba | B66B 1/468<br>187/381 |
| 2015/0068849 | A1 | 3/2015 | Haipus et al. | |
| 2017/0297864 | A1* | 10/2017 | Koivisto | B66B 1/463 |

FOREIGN PATENT DOCUMENTS

| | | | |
|---|---|---|---|
| CN | 105438902 | A | 3/2016 |
| JP | H03143879 | A | 6/1991 |
| JP | H03162372 | A | 7/1991 |
| JP | H04286580 | A | 10/1992 |
| JP | H0873136 | A | 3/1996 |
| JP | 2003252536 | A | 9/2003 |
| JP | 2014162620 | A | 9/2014 |
| WO | 2016073067 | A1 | 5/2016 |
| WO | 2016124810 | A1 | 8/2016 |

OTHER PUBLICATIONS

Written Opinion of the International Searching Authority for application No. PCT/US2017/055323 dated Feb. 1, 2018; 8 pages.

Cohen, Simon, Elevator Buttons Suck, Excitable, Jun. 13, 2007. 17 Pages. Retrieved from the Internet on Jan. 17, 2017.

Elevator Car Call Cancellation. Elevatorpedia. Retrieved from the Internet on Jan. 17, 2017. 5 Pages. <URL: http://elevation.wikia.com/wiki/Elevator_car_call_cancellation>.

Why Don't Most Elevator Panels Let You Unselect? User Experience Stack Exchange. 4 Pages. Retrieved from the Internet on Jan. 17, 2017. <URL: http://ux.stackexchange.com/questions/19612/why-dont-most-elevator-panels-let-you-unselect>.

* cited by examiner

ELEVATOR SYSTEM AND METHOD OF CANCELLING PASSENGER REQUESTED FLOOR DESTINATION

BACKGROUND

The present disclosure relates to an elevator system, and more particularly, to a floor destination cancellation feature of the elevator system.

Elevator systems may include multiple elevator gates serving multiple floors of a building. Each gate may be associated with a hoistway that may contain at least one elevator car traveling between floors. Control systems of the elevator system strive to achieve optimal performance in getting passengers swiftly and efficiently to their destinations. However, current displays and call panels/buttons may be confusing to some passengers and/or may occasionally allow for a user, accidentally or intentionally, to make an incorrect floor destination selection. It is desirable to provide call panels near landing doors and/or inside an elevator car that offer passengers an enhanced and/or unique elevator experience including the ability to cancel previously selected floor destination requests.

SUMMARY

An elevator system according to one, non-limiting, embodiment of the present disclosure includes an elevator car constructed and arranged to travel in a hoistway defined by a building and between floors of the building; a call panel located for passenger interaction, and including a plurality of floor selections; a controller configured to communicate with the call panel; and a floor cancellation feature associated with at least one of the call panel and the controller, wherein the controller is configured to operate between a floor cancellation permit state and a floor cancellation restricted state thereby respectively enabling and disabling the floor cancellation feature, and track at least one event associated with the floor cancellation restricted state.

In addition to the foregoing embodiment, the call panel is a car call panel.

In the alternative or additionally thereto, in the foregoing embodiment, the call panel is a floor call panel.

In the alternative or additionally thereto, in the foregoing embodiment, the controller is configured to receive and monitor at least one floor destination selected by at least one passenger via a floor selection of the plurality of floor selections, and each of the at least one selected floor destination is associated with a distinct one of the floor cancellation permit state and the floor cancellation restricted state in any given moment in time.

In the alternative or additionally thereto, in the foregoing embodiment, the at least one event associated with a first selected floor destination of the at least one selected floor destination is a later second selected floor destination in a given moment in time.

In the alternative or additionally thereto, in the foregoing embodiment, the at least one event associated with the first selected floor destination includes subsequent motion of the elevator car.

In the alternative or additionally thereto, in the foregoing embodiment, the at least one event associated with the first selected floor destination includes expiration of a time interval initiated by the controller upon the initial selection of the first selected floor destination.

In the alternative or additionally thereto, in the foregoing embodiment, the at least one event associated with the first selected floor destination includes expiration of a time interval initiated by the controller upon the initial selection of the first selected floor destination.

In the alternative or additionally thereto, in the foregoing embodiment, the floor cancellation feature includes a cancel selection of the call panel.

In the alternative or additionally thereto, in the foregoing embodiment, the plurality of floor selections and the cancel selection are buttons configured to visually change when selected.

In the alternative or additionally thereto, in the foregoing embodiment, a first selected floor destination is adapted to visually flash after the cancel selection is selected and the controller is in the floor cancellation permit state.

In the alternative or additionally thereto, in the foregoing embodiment, the first selected floor destination is configured to de-illuminate after the first selected floor destination is re-selected while visually flashing thereby canceling the initial selection of the first selected floor destination.

In the alternative or additionally thereto, in the foregoing embodiment, the re-selection is conducted by depressing the first selected floor destination for a prescribed period of time.

An elevator system according to another, non-limiting, embodiment includes an elevator car constructed and arranged to travel in a hoistway defined by a building and between areas of the building; a first car call panel disposed in the elevator car, and including a first plurality of area selections; a second car call panel disposed in the elevator car, and including a second plurality of area selections; a controller configured to individually communicate with the first and second call panels; and a first floor cancellation feature associated at least in-part with the first car call panel, wherein the controller is configured to operate between a first area cancellation permit state and a first area cancellation restricted state thereby respectively enabling and disabling the first area cancellation feature, and track at least one event associated with the first area cancellation restricted state; and a second area cancellation feature associated at least in-part with the second car call panel, wherein the controller is configured to operate between a second area cancellation permit state and a second area cancellation restricted state thereby respectively enabling and disabling the second area cancellation feature, and track at least one event associated with the second area cancellation restricted state.

A method of operating a floor cancellation feature of an elevator system according to another, non-limiting, embodiment includes selecting a first floor selection; operating a controller in a cancellation permit state; initiating an event module specific to the first floor selection; acknowledging an event occurrence; and operating the controller in a cancellation restricted state.

Additionally to the foregoing embodiment, the method includes visually altering the first floor selection indicating selection.

In the alternative or additionally thereto, in the foregoing embodiment, the event occurrence includes the subsequent selection of a second floor selection.

In the alternative or additionally thereto, in the foregoing embodiment, the event occurrence includes the expiration of time initiated at the selection of the first floor selection.

In the alternative or additionally thereto, in the foregoing embodiment, the event occurrence includes motion of the elevator car.

In the alternative or additionally thereto, in the foregoing embodiment, the event occurrence includes closure of an elevator system door.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
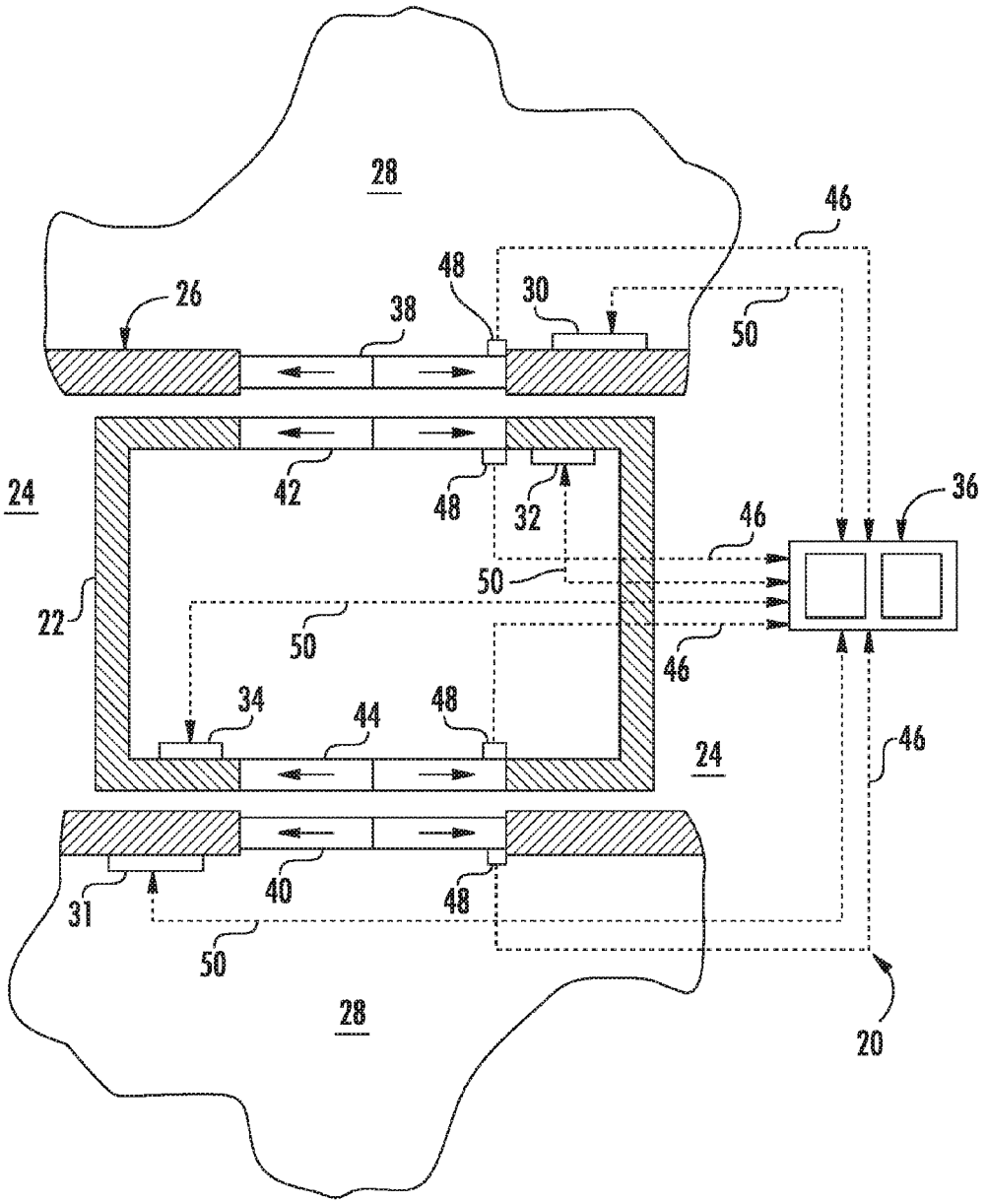
FIG. 1 is a schematic of an elevator system in an exemplary embodiment of the present disclosure.

Referring to FIG. 1, an exemplary embodiment of an elevator system 20 is illustrated. The elevator system 20 may include an elevator car 22 adapted to move within a hoistway 24 having boundaries defined by a structure or building 26, and between a multitude of floors or areas 28 of the building 26. The elevator system 20 may further include a plurality of call panels (four illustrated as 30, 31, 32, 34), and a controller 36. The elevator car 22 is propelled by a propulsion system (not shown) that may be controlled by the controller 36 of the elevator system 20. Examples of a propulsion system may include self-propelled or ropeless (e.g., magnetic linear propulsion), roped, hydraulic, and other propulsion systems. It is further contemplated and understood that the hoistway 24 may extend, and thus the car 22 may travel, in a vertical direction, a horizontal direction, and/or a combination of both.

The elevator system 20 may further include a multitude of gates or doors (i.e., two illustrated as 38, 40) located at each floor 28, which barriers the otherwise exposed hoistway 24 for the protection of waiting passengers yet to board the elevator car 22. The elevator car 22 may include at least one door (i.e., two illustrated as 42, 44) that protects the passengers riding within the elevator car 22 while moving. The monitoring and actuation of all doors 38, 40, 42, 44 may be controlled by the controller 36 via, for example, electrical signals (see arrows 46) received from a sensor 48 (e.g., motion and/or position sensors) positioned at each door 38, 40, 42, 44. The sensors 48 may motion and/or position sensors, and may further be an integral part of door actuators (not shown) that facilitate door opening and closing functions.

The floor doors 38, 40 may be located at opposite sides of the hoistway 24. In one example, the doors 38, 40 may be located on some floors 28 and only one of the doors 38, 40 may be located on other floors 28. The car doors 42, 44 may be respectively located on opposite sides of the elevator car 22. Car door 42 may be associated with floor door 38, and car door 44 may be associated with floor door 40. When a passenger enters and exits the elevator car 22 at a specific floor 28, door pair 38, 42 or door pair 40, 44 must be open. Before the elevator car 22 begins to travel, all doors 38, 40, 42, 44 must be closed. The controller 36 may monitor and control all of these events. It is contemplated and understood that a single elevator car may be associated with a single set of doors, three sets of doors, or more.

Figure 2:
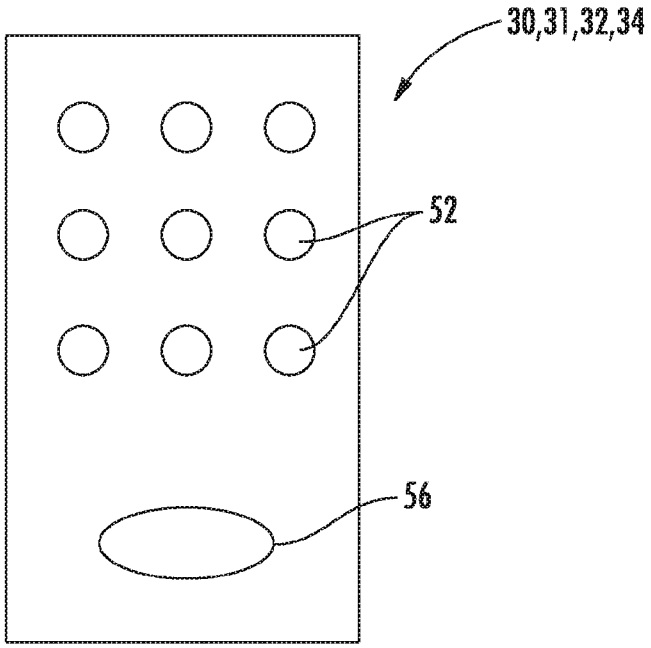
FIG. 2 is a front view of a call panel of the elevator system.

Referring to FIGS. 1 and 2, the call panels 30, 31, 32, 34 may be configured for two-way communication via electric signals (see arrows 50) with the controller 36. In one example, the call panels 30, 31 may be floor call panels located adjacent to respective doors 38, 40 on each floor 28. That is, each floor call panel 30, 31 may be mounted to a wall of the building 26. The call panels 32, 34 may be car call panels located inside the elevator car 22 and, in one example, adjacent to respective car doors 42, 44. Any one or more of the call panels 30, 31, 32, 34 may be an interactive touch screen with the images of each call selection 52 (i.e., interactive floor or area destination selections) displayed on the screen and configured to visually change when selected. Alternatively, any one or more call panels 30, 31, 32, 34 may include mechanical buttons that may be configured to, for example, illuminate when selected. In one alternative embodiment, the elevator system 20 may include floor call panels 30, 31 that provide a selection of desired car travel direction (e.g., up and down directions represented by arrow) and the car call panels 32, 34 may provide the actual call selection 52 relative to a desired floor destination. It is contemplated and understood that many other configurations and locations of the call panels 30, 31, 32, 34 may be applicable to the present disclosure. It is contemplated and understood that the call panels 30, 31, 32, 34 may include a host of other capabilities and may be programmable and/or may include a processor that may be part of the controller 34.

Figure 3:
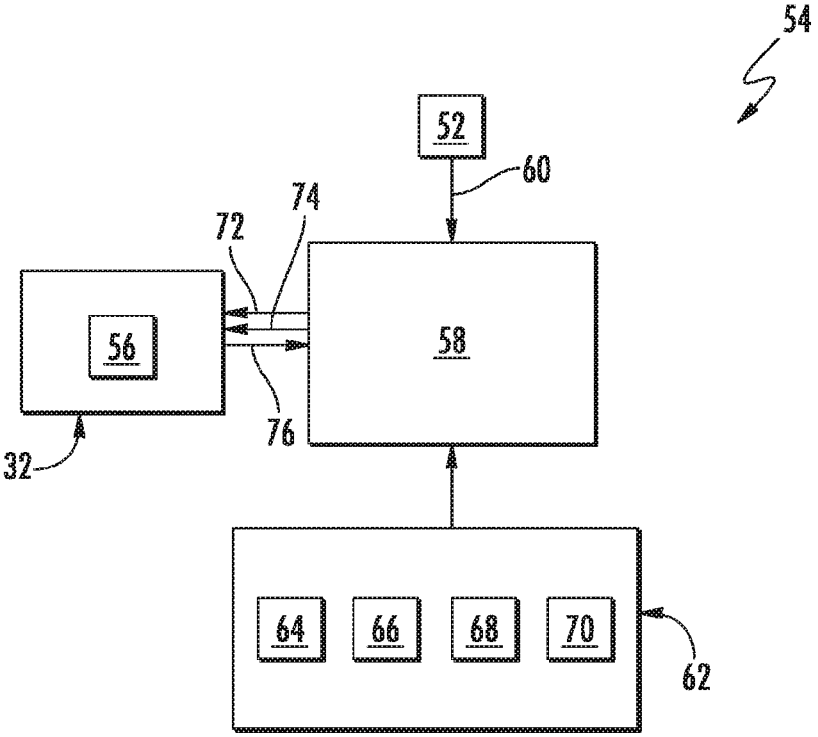
FIG. 3 is a schematic of a floor cancellation feature of the elevator system.

Referring to FIG. 2, a general passenger panel is illustrated that may represent any one of the panels 30, 31, 32, 34. Referring to FIG. 3, a floor cancellation feature 54 is illustrated that may include a cancel selection 56 supported or displayed on the panels 30, 31, 32, 34 (see FIG. 2). In one embodiment, the elevator system 20 may generally include two floor cancellation features 54, with a first feature associated with panel pair 30, 32, and a second feature associated with panel pair 31, 34. To simplify explanation, the floor cancellation feature 54 will be described with reference to the car call panel 32, however, it is understood that other similar floor cancellation features 54 may be associated with the remaining call panels 30, 31, 34. In one embodiment, the floor cancellation feature 54 may be an integral part of both the car panel 32 and the controller 36.

In one embodiment, the floor cancellation feature 54 may include the cancel selection 56 as part of the panel 32, a multitude of sensory input signals to the controller 36, and various circuitry, subroutine modules and/or software as part of the controller 36. More specifically, a module 58 of the floor cancellation feature 54 may be at least in-part software-based and may be an integral part of the controller 36. The module 58 may be configured to record the latest passenger selected floor destination received as an input signal (see arrow 60 in FIG. 3) sent as a result of a passenger selecting the desired floor selection 52. Upon this selection, the module 58 as part of the controller 36 is placed in a 'floor cancellation permit state' and an event module 62 of the floor cancellation feature 54 may continue or begin to monitor for, or track, the occurrence of at least one predefined event via any variety of sensors and/or devices.

Once the predefined event occurs, the event module 62 may cause the module 58 to operate in a 'floor cancellation restricted state' with regard to the selected floor destination that initially caused the controller to operate in the 'floor cancellation permit state.' It is understood that the term 'floor cancellation permit state' is a state where a passenger may cancel a previous floor selection, and the 'floor cancellation restricted state' is a state where the passenger may not cancel the previous floor selection due to the occurrence of an event.

The event module 62 may include, for example, at least one of a timer or timer input 64, a car motion sensor or car in motion input 66, door position sensors or doors closed input 68, a subsequent floor selection input 70, and other inputs that may be associated with a particular application. In operation and upon initial floor destination selection by a passenger via car call panel 32, the module 58 is configured to operate in the floor cancellation state with regard to the specific floor destination selection, and may initiate the timer 64 that begins a count-down (i.e., a time duration). Upon expiration of the timed duration, the timer input 64 may be sent to the module 58 which then begins operation in the floor cancellation restricted state. In one embodiment, this permissive time duration may be about ten (10) seconds. In another example, this time duration may be stopped prematurely once the elevator doors close and/or the elevator car begins motion. In one embodiment, the permissive time duration may be greater than or less than ten (10) seconds.

When the module 58 begins operation in the cancellation permit state, the module 58 may output a permit signal (see arrow 72) to the car call panel 32. The permit signal 72 may cause the cancel selection 56 to, for example, illuminate, thus indicating to a passenger that the floor destination selection can be cancelled. If the passenger desires to cancel the selection, the passenger may first select the illuminated cancel selection 56 that then causes the specific floor selection 52 to switch from being illuminated (i.e., an indication of the previous selection) to a flashing illumination condition. The flashing illumination condition of the floor selection 52 prompts the passenger to re-select the floor selection 52, thus cancelling the specific, previously selected, floor destination altogether. In another embodiment, the re-selection of the floor selection 52 may require the selection to be held for a brief period of time (e.g., about three seconds) and until the floor selection 52 de-illuminates indicating the floor selection has been successively cancelled.

Figure 4:
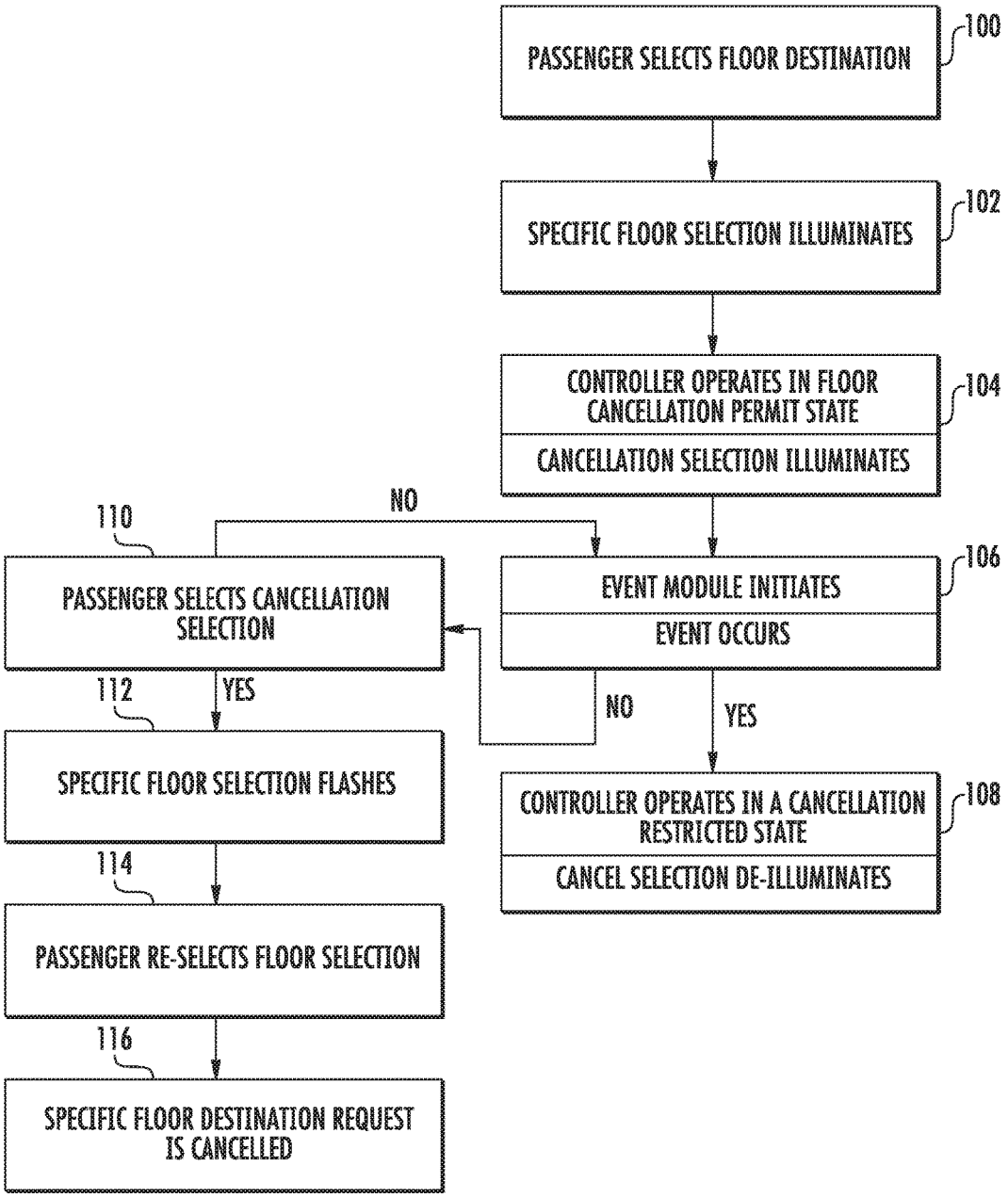
FIG. 4 is a flow diagram of a method of operating the floor cancellation feature.

Referring to FIG. 4, a method of operating a floor cancellation feature 54 of the elevator system 20 is illustrated. At block 100, a passenger selects a floor destination from a plurality of floor selections 52 on a call panel 32. At block 102, the specific floor selection 52 may illuminate. At block 104, a module 58 begins to operate in a floor cancellation permit state and a cancel selection 56 illuminates. At block 106 and upon initiation of the permit state, an event module 62 initiates to monitor for an event. If the event occurs and at block 108, the module 58 begins to operate in a cancellation restricted state causing a signal 74 (see FIG. 3) to be sent to the panel 32 whereupon the illumination of the cancel selection 56 is extinguished providing a passenger indication that the option to cancel is no longer available.

At block 110 and when the module 58 is in the cancellation permit state, a passenger may select the illuminated cancel selection 56. At block 112, the specific floor selection may begin to flash and may continue to flash until an event occurs via the event module 62, or at block 114, the passenger reselects the floor selection. At block 116 and upon reselection, the call panel 32 may send a signal 76 (see FIG. 3) to the module 58 causing the floor destination call/request to be cancelled, and the specific floor selection may de-illuminate indicating it is no longer selected. It is contemplated and understood that the cancellation of a previous floor selection may be perform in the elevator car 22 or as part of a hall or lobby call. It is further understood that only the last (i.e., previous) call may be cancelled provided an event has not since occurred. For example, in one embodiment, in the case where floors 3, 5, 8, 7, and 3 are selected in succession, it would not be possible for a passenger to cancel the call to the third floor because the system only permits the last call to be cancelled. Since floor 3 was selected more than once and was not only the last call, it may not be cancelled. Non-limiting examples of events may include the lapsing of a time duration, the closure of elevator doors, motion of the elevator car, a subsequent floor selection, and others.

It is further contemplated and understood that for elevator cars 22 having more than one car call panel such as panels 32, 34, the floor cancellation features 54 is generally independent for each panel. That is, a passenger would be able to cancel the most recent floor destination selection made on panel 32 and from panel 32, and even if another floor destination selection is made on the other panel 34 and after the floor destination selection made on panel 32. It is further contemplated and understood that the floor cancellation feature may be linked between various panel combinations.

The controller 36 may include a processor 80 (e.g., microprocessor) and a computer writeable and readable storage media 82 (see FIG. 1). The controller 36 may be part of, one or more Application Specific Integrated Circuit(s) (ASIC), electronic circuit(s), central processing unit(s) (e.g., microprocessor and associated memory and storage) executing one or more software or firmware programs and routines, combinational logic circuit(s), input/output circuit(s) and devices, appropriate signal conditioning and buffer circuitry, and other components to provide the described functionality.

Software, firmware, programs, instructions, routines, code, algorithms and similar terms mean any controller executable instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators and other devices The present disclosure may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Benefits and advantages of the present disclosure include the ability to cancel elevator service to a particular area/floor that is not required resulting in overall improved elevator performance other advantages include the passenger ability to cancel a mistakenly pressed floor destination selection, and may eliminate any malicious intent of one passenger cancelling a floor destination request by another passenger.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator system comprising:

an elevator car constructed and arranged to travel in a hoistway defined by a building and between floors of the building;

a call panel located for passenger interaction, and including a plurality of floor selections;

a controller configured to communicate with the call panel; and a floor cancellation feature associated with at least one of the call panel and the controller, wherein the controller is configured to operate between a floor cancellation permit state and a floor cancellation restricted state thereby respectively enabling and disabling the floor cancellation feature, and track at least one event associated with the floor cancellation restricted state.

2. The elevator system set forth in claim 1, wherein the call panel is a car call panel.

3. The elevator system set forth in claim 1, wherein the call panel is a floor call panel.

4. The elevator system set forth in claim 1, wherein the controller is configured to receive and monitor at least one floor destination selected by at least one passenger via a floor selection of the plurality of floor selections, and each of the at least one selected floor destination is associated with a distinct one of the floor cancellation permit state and the floor cancellation restricted state in any given moment in time.

5. The elevator system set forth in claim 4, wherein the at least one event associated with a first selected floor destination of the at least one selected floor destination is a later second selected floor destination in a given moment in time.

6. The elevator system set forth in claim 5, wherein the at least one event associated with the first selected floor destination includes subsequent motion of the elevator car.

7. The elevator system set forth in claim 5, wherein the at least one event associated with the first selected floor destination includes expiration of a time interval initiated by the controller upon the initial selection of the first selected floor destination.

8. The elevator system set forth in claim 6, wherein the at least one event associated with the first selected floor destination includes expiration of a time interval initiated by the controller upon the initial selection of the first selected floor destination.

9. The elevator system set forth in claim 1, wherein the floor cancellation feature includes a cancel selection of the call panel.

10. The elevator system set forth in claim 9, wherein the plurality of floor selections and the cancel selection are buttons configured to visually change when selected.

11. The elevator system set forth in claim 10, wherein a first selected floor destination is adapted to visually flash after the cancel selection is selected and the controller is in the floor cancellation permit state.

12. The elevator system set forth in claim 11, wherein the first selected floor destination is configured to de-illuminate after the first selected floor destination is re-selected while visually flashing thereby canceling the initial selection of the first selected floor destination.

13. The elevator system set forth in claim 12, wherein the re-selection is conducted by depressing the first selected floor destination for a prescribed period of time.

14. A method of operating a floor cancellation feature of an elevator system comprises:

selecting a first floor selection;

operating a controller in a cancellation permit state;

initiating an event module specific to the first floor selection;

acknowledging an event occurrence; and operating the controller in a cancellation restricted state, wherein the event occurrence includes at least one of subsequent selection of a second floor selection, motion of the elevator car, and closure of an elevator system door.

15. The method set forth in claim 14 further comprising: visually altering the first floor selection indicating selection.

* * * * *